United States Patent [19]

Ito et al.

[11] 4,420,345

[45] Dec. 13, 1983

[54] METHOD FOR MANUFACTURE OF ALUMINUM ALLOY CASTING

[75] Inventors: Tadao Ito, Fuji; Akio Hashimoto, Numazu, both of Japan

[73] Assignee: Nippon Light Metal Company Limited, Tokyo, Japan

[21] Appl. No.: 321,881

[22] Filed: Nov. 16, 1981

[51] Int. Cl.[3] ..... C22F 1/04

[52] U.S. Cl. ..... 148/3; 148/159; 148/415

[58] Field of Search ..... 148/3, 159, 32.5

[56] References Cited

FOREIGN PATENT DOCUMENTS 37-10901 8/1962 Japan .

*Primary Examiner*—R. Dean

*Attorney, Agent, or Firm*—William J. Daniel

[57] ABSTRACT

A cast article of aluminum alloy is produced by pouring into a mold a molten Al-Si-Mg type casting alloy having an antimony (Sb) content in the range of about 0.03%-1.0% by weight and, while the alloy cast body is cooling following complete solidification but before its temperature has fallen below 450° C., placing the solidified cast body into a heating furnace kept at temperatures in the range of from 500° to 550° C. and retaining it at an intermediately high-temperature within that temperature range for not more than 30 minutes, subsequently quenching said cast body in cold water or hot water and thereafter subjecting the quenched cast body to a conventional artificial aging treatment.

The resulting cast articles are, in terms of strength, toughness and resistance to thermal shocks, comparable with or superior to cast articles obtained by conventional methods but can be manufactured in a reduced period of time with consequential savings in cost.

3 Claims, 1 Drawing Figure

METHOD FOR MANUFACTURE OF ALUMINUM ALLOY CASTING

BACKGROUND OF THE INVENTION

1. Field of the Invention:

This invention relates to an improved method for the manufacture of cast aluminum articles from Al-Si-Mg type casting alloys.

The term "Al-Si-Mg type casting alloys" as used herein means the Al-Si-Mg alloys of the type corresponding to those designated as AC4A and AC4C by Japanese Industrial Standard for Aluminium Alloy Castings (JIS H5202). Since these Al-Si-Mg type casting alloys have good casting properties, possess appropriate strength and toughness, and excel in weldability, they are widely used for parts for engines in automobiles and ships and other machine parts.

2. Description of the Prior Art:

Heretofore in the manufacture of cast articles of these alloys, the alloys after melting and pouring into molds have been subjected to a solid solution heat treatment and then to quenching and an artificial aging heat treatment in order to acquire the necessary strnegth and toughness. The solid solution heat treatment has to be carried out at elevated temperatures within the range of from 500° to 550° C. for long periods ranging from several hours to ten or more hours. Further, the aging step needs to continue at temperatures within the range of from 140° to 200° C. for similarly long periods ranging from several hours to ten or more hours. These treatments have necessarily affected the casting operation adversely notably from the standpoints of production efficiency and heat economy.

With a view to avoiding these disadvantages involved in castings of the type requiring thermal treatment, there has been proposed a so-called "solutioning casting method" which, as disclosed in Japanese Patent Publication No. 10901/1962, for example, comprises quenching the casting body to room temperature immediately after casting, thereby simultaneously effecting quenching and formation of supersaturated solid solution, and subsequently subjecting the shaped alloy body to the artificial aging treatment.

However, when this "solutioning casting method" is applied to alloys having the composition contemplated by the present invention, the ultimate cast articles obtained after the aging treatment lack sufficient strength and toughness as compared with the products of the so-called T6 material which have undergone conventional aging subsequently to conventional solution heat treatment.

SUMMARY OF THE INVENTION

The inventors have studied the various drawbacks encountered in the manufacture of cast articles from alloys of the aforementioned type and consequently have found that, by adding a small amount of antimony to said alloy and, preparatory to the quenching treatment, interrupting the normal, cooling stage following casting while the cast articles are at an intermediate high temperature and retaining said cast articles at that high temperature for a limited time said cast articles at the end of the treatment for artificial aging have acquired a degree of strength and toughness comparable with or even superior to those acquired by the castings produced by the conventional method, even if the intermediate level treatment extends for only a short period on the order of 5 to 30 minutes. Further, the intermediate temperature treatment, when carried out as described above, enables the cast products of alloys to avoid deformation or uneven strength distribution otherwise often entailed by the modified thermal treatment described above.

Specifically, this invention relates to a method for the manufacture of cast articles of aluminum alloy, characterized by casting a molten Al-Si-Mg type alloy containing 0.03 to 1.0 percent of antimony into a mold, placing the completely solidified cast bodies in a heating furnace kept at a temperature in the range of from 500° to 500° C. before it has cooled to a temperature below 450° C., thereby subjecting the solidified cast bodies to an intermediate temperature treatment for a short time up to about 30 minutes, then quenching said cast bodies in cold water or warm water, and subjecting the quenched cast bodies to an artificial aging treatment in the usual way.

DETAILED DESCRIPTION OF THE INVENTION

Figure 1:
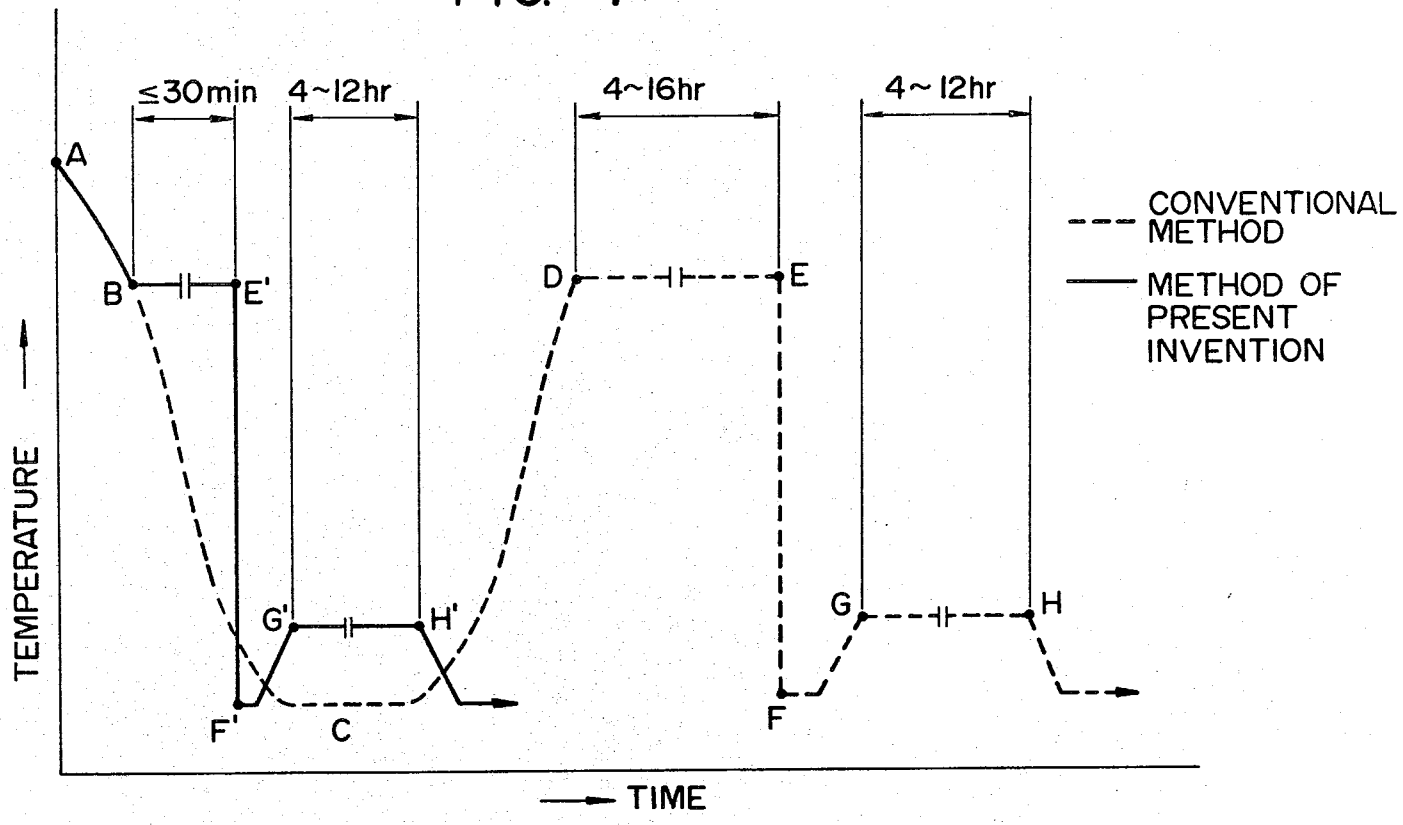
FIG. 1 is a comparison of model flow diagrams of the manufacture of cast articles from an Al-Si-Mg type alloy according to the method of the present invention and the conventional method.

According to this invention, when a aluminum alloy cast body is retained briefly at a specified high temperature, it can be immediately subjected to the usual quenching and artificial aging treatments. Since the alloy is no longer required to undergo any time-consuming solid solution treatment, the total manufacturing time for cast articles can be notably shortened and all the treatments involved can be performed continuously. Thus, the method of this invention not merely enhances production efficiency but also proves highly advantageous from the standpoint of heat economy.

Now, the present invention will be described in comparison with the conventional method, with reference to the model flow diagrams of FIG. 1. In FIG. 1, the solid line indicates the process flow by the present invention and the broken line that by the conventional method.

In the diagram, the alphabetic symbols designating the various process steps involved are explained as follows:

| (Conventional method) | | (Method of this invention) | |
|---|---|---|---|
| A → B | Completion of solidification | A → B (B') | Completion of solidification |
| B → C | Spontaneous | B (B') → E' | Retention at intermediate high temperature |
| C → D | Heating for temperature elevation | E' → F' | Quenching |
| D → E | Treatment for solid solution | F' → G' → H' | Treatment for artificial aging |
| E → F | Quenching | | |
| F → G H | Treatment for artificial aging | | |

By the conventional method, the cast articles of an Al-Si-Mg type alloy are manufactured by the steps of pouring into the metal mount mold a molten alloy at a temperature in the neighborhood of 720° C. and, after the molten alloy has completely solidified, allowing the solid cast bodies to cool off spontaneously from its solidification temperature to room temperature (A→B→C), then heating the cast bodies to a temperature within the range of from 500° to 550° C., appropriate to the solid solution heat treatment and retaining the cast bodies at this elevated temperature for a period of from four to 16 hours (C→D→E), subsequently quenching the cast bodies in cold water or in hot water at a temperature in the range of from 60° to 100° C. (E→F) and finally subjecting the cast bodies to aging at a temperature in the range of from 140° to 200° C. for a period of from four to 12 hours.

By the conventional method, therefore, the series of thermal treatments requires a fairly long time.

By contrast, in the case of this invention, cast articles possessing degrees of strength and toughness comparable to those produced by the conventional method as described above, can be obtained by similarly causing the molten alloy to solidify in the mold, then after solidification is completed, placing the solid cast bodies in a heating furnace kept at an intermediate level temperature in the range of from 500° to 550° C., while the cast bodies are still at a high temperature during cooling retaining the cast bodies therein at the intermediate temperature for 5 to 30 minutes (A→B→E'), then immediately quenching the cast bodies in cold water or hot water (E'→F'), and thereafter subjecting the quenched cast bodies to an ordinary treatment for artificial aging. Thus, as a whole, the time required for the manufacture of the cast articles are notably decreased and the steps can be readily performed in a continuous operation.

The antimoney which is used in the present invention is an element frequently added to Al-Si type alloys for the improvement of cast structure. When added to Al-Si-Mg type alloys, it imparts unsightly spots in a brown to dark purple color to the cast article obtained after the thermal treatment steps and these spots seriously impair the market value of the cast article. In the practice of this invention, the added antimony does not impart such unsightly spots so that the cast product has a good appearance.

The continuous operation can integrate all of the steps of pouring the molten alloy into the mold, retaining the solidified cast bodies at the intermediate high temperature, and immediately quenching the solid cast bodies in water. Optionally it may be extended to include the final step of artificial aging.

The equipment needed for carrying out these steps in a continuous operation includes tunnel furnaces for use as the heating furnace at the various steps plus link conveyors for advancing the cast articles between the adjacent steps. These facilities are well known in the art.

Now, the present invention will be described with reference to working examples.

Alloys of the different compositions indicated as Examples (1) and (2) in Table 1 (which lists alloys of the types designated as AC4A and AC4C in JIS-H5202) were each melted in a smelting furnace and, after thorough fusion and treatment for expulsion of entrapped gas and removal of slag, subsequently poured at 720° C. into a boat-shaped testing mold of JIS H-5202 preheated to about 150° C. and, after complete solidification therein, subjected to various after-treatments indicated below:

(a) Conventional method (1), comprising the steps of allowing the solidified alloy cast bodies to cool off spontaneously to room temperature, and then subjecting the solid cast bodies for a solution heat treatment, quenching and artificial aging.

(b) Known alternative method described in the Japanese Patent Publication No. 10901/1962 (2), comprising the steps of immediately quenching the solidified cast alloy bodies after the usual casting in cold water and subjecting the quenched cast bodies to treatment for artifical aging.

(c) Method of this invention, comprising the steps of immediately placing the solidified cast bodies after the usual casting in a heating furnace, before it has cooled substantially for retention therein at an intermediate high temperature for a short time, and thereafter subjecting the cast bodies to quenching and artificial aging.

The cast articles resulting from the several after-treatments were visually inspected for surface condition and tested for certain mechanical properties. The results are shown in Table 1.

In the alloys of the type AC4C of Example (2), the alloy identified (d) in which sodium (an element usually employed in alloys of this kind as an additive component for improvement of alloy cast structure) was incorporated in lieu of antimony as an alloy component, was subjected to the procedure of the present invention. The test results obtained of the casting of this alloy are shown in the table for purpose of comparison.

The conditions of heat treatments given to the various alloys of Table 1 are summarized in Table 2.

TABLE 1

| Example No. | Designation of alloy | Type of thermal treatment | Chemical composition (%) | | | | | | Mechanical properties | | | |
|---|---|---|---|---|---|---|---|---|---|---|---|---|
| | | | Si | Mg | Mn | Sb | Na | Al | Tensile strength (kg/mm²) | 0.2% yield strength (kg/mm²) | Elongation (%) | Spots on surface |
| 1 | AC4A | a[1] | 9.0 | 0.6 | 0.5 | — | — | Balance | 29.4 | 20.1 | 3.1 | Nil |
| | | b[2] | 9.1 | 0.6 | 0.5 | — | — | " | 26.3 | 18.0 | 1.1 | Yes |
| | | c[3] | 9.1 | 0.6 | 0.5 | 0.13 | — | " | 30.5 | 21.3 | 6.9 | Nil |
| 2 | AC4C | a[1] | 7.0 | 0.4 | — | — | — | " | 26.4 | 16.6 | 10.4 | Nil |
| | | b[2] | 7.0 | 0.4 | — | — | — | " | 24.0 | 15.9 | 4.1 | Yes |
| | | c[3] | 7.0 | 0.4 | — | 0.15 | — | " | 26.7 | 16.3 | 18.8 | Nil |
| | | d[4] | 7.0 | 0.4 | — | — | 0.01 | " | 25.2 | 16.0 | 5.1 | Nil |

[1]Conventional Method
[2]Method of Japanese P.P. No. 10901/1962
[3]Method of Invention
[4]Method of Invention Substituting Sodium for Antimony.

TABLE 2

| Example No. | Designation of alloy | Type of thermal treatment | Solution heat treatment (Retention at intermediately high temperature) | Quenching | Artificial aging |
|---|---|---|---|---|---|
| 1 | AC4A | a[1] | 540° C. × 8 hrs. | In cold water | 160° C. × 10 hrs. |
| | | b[2] | — | In cold water | " |
| | | c[3] | 540° C. × 8 min. | In cold water | " |
| 2 | AC4C | a[1] | 530° C. × 10 hrs. | In cold water | 150° C. × 6 hrs. |
| | | b[2] | — | In cold water | " |
| | | c[3] | 530° C. × 10 min. | In cold water | " |
| | | d[4] | " | In cold water | " |

[1]Conventional Method
[2]Method of Japanese P.P. No. 10901/1962
[3]Method of Invention
[4]Method of Invention Substituting Sodium for Antimony.

From the test results seen in Table 1, it is evident that in both of Examples (1) and (2), the sample cast bodies obtained in Run (c) corresponding to the method of this invention wherein the thoroughly solidified cast bodies before being subjected to quenching were retained about 8 to 10 minutes at an intermediate high temperature and then given a treatment for artificial agings were, in terms of strength and toughness, comparable with or even superior to the sample cast bodies obtained in Run (a) wherein the cast bodies were subjected to a length solid solution heat treatment and far superior to the sample cast bodies obtained in Run (b) wherein the cast bodies were subjected to quenching and artificial aging immediately after solidification without going through any retention at an intermediate high temperature or any solution heat treatment.

It is evident from the test results for Run (d) in Example (1) that the effect of the present invention reflected in the notable decrease in the total time required for the heat treatment cannot be obtained with an alloy using sodium for an improvement of cast structure in the place of antimony.

Since the products obtained by the present invention are free of dark spots on their surface, their commercial value is unimpaired.

Heretofore, for cast articles of Al-Si-Mg type casting alloys to acquire adequate toughness, it has been necessary for them to undergo a prolonged period of thermal treatments. The present invention, as described above, produces these cast articles possessing more desirable strength properties by the steps of casting the molten alloy into a mold, after complete solidification of the cast bodies, retaining them at an intermediate high-temperature briefly before they have cooled below a specified level, then quenching the cast bodies, and finally subjecting them to a treatment for artificial aging as usual. Compared with the conventional method, the method of this invention permits a drastic reduction in the overall time required for heat treatment steps. Thus, the method of this invention proves advantageous for the manufacture of cast articles of the aluminum alloys in question.

What is claimed is:

1. A method for the manufacture of cast articles of aluminum alloy, which comprises the steps of (1) pouring into a metal mold a molten Al-Si-Mg type casting alloy containing antimony (Sb) in the range of 0.03 to 1.0% by weight; (2) after complete solidification of the cast body within the mold but before said cast body has cooled below about 450° C., placing said cast body in a heating furnace kept at temperatures in the range of from 500° to 550° C. for about 5–30 minutes; (3) then quenching the cast body in cold water or warm water; and (4) subjecting the quenched cast body to a conventional artificial aging treatment.

2. The method of claim 1, wherein the steps of casting of molten alloy, maintaining it in said range of 500°–550° C., and quenching are carried out in a continuous operation.

3. The method of claim 2 wherein said aging treatment is included in said continuous operation.

* * * * *